United States Patent [19]

Barrett et al.

[11] Patent Number: 4,805,765

[45] Date of Patent: Feb. 21, 1989

[54] DISPENSING PACKAGE FOR SMALL ARTICLES

[76] Inventors: Charles G. Barrett, 247 Neptune Dr., Groton, Conn. 06340; James B. Malloy, 73 Keeney Ave., West Hartford, Conn. 06107

[21] Appl. No.: 140,817

[22] Filed: Jan. 5, 1988

[51] Int. Cl.[4] ..... B65D 5/38; B65D 5/36

[52] U.S. Cl. ..... 206/45.15; 229/11; 229/20; 222/50

[58] Field of Search ..... 206/45.15; 229/11, 20; 222/363, 50

[56] References Cited

U.S. PATENT DOCUMENTS

| | | | |
|---|---|---|---|
| 369,408 | 9/1887 | Mendizabal | 229/11 |
| 623,537 | 4/1899 | Grange . | |
| 702,083 | 6/1902 | Wormwood et al. . | |
| 1,937,222 | 11/1933 | Gallahan | 229/11 |
| 2,083,349 | 6/1937 | Seyl | 45/7 |
| 2,235,473 | 3/1941 | Bunstrub | 229/20 |
| 2,311,718 | 2/1943 | Way | 312/149 |
| 2,378,868 | 6/1945 | Richmond et al. | 312/35 |
| 2,532,623 | 12/1950 | Jones | 312/273 |
| 2,614,019 | 10/1952 | Olson et al. | 312/273 |
| 2,690,870 | 10/1954 | Harman | 232/432 |
| 2,815,891 | 12/1957 | Handel | 222/363 |
| 3,315,843 | 4/1967 | Tumbleson | 222/50 |
| 3,814,492 | 6/1974 | Jacobs | 312/273 |

*Primary Examiner*—Joseph Man-Fu Moy
*Attorney, Agent, or Firm*—McCormick, Paulding & Huber

[57] ABSTRACT

A counter display package for dispensing small articles comprises a generally rectangular carton containing a drawer which forms a bottom portion of the carton. A tear-away panel in the front wall of the carton is removed to expose a drawer opening through which the drawer is pulled from a closed to an open position. A chute wall hingedly connected to the drawer extends a substantial distance above the drawer and is disposed within the carton and generally adjacent the rear wall of the carton when the drawer is closed. The chute panel is retained in the latter position by loosely packed small articles contained within the carton. When the drawer is opened the chute panel assumes a position wherein it is forwardly and downwardly inclined from the carton rear wall to the drawer. The inclined chute wall cooperates with portions of the carton front and side walls to form a hopper for directing small articles from the upper portion of the carton into the drawer. As each article is removed from the open drawer it is replaced by another article fed from the hopper into the drawer. Thus, the drawer remains in a substantially full or dispensing condition until the display carton is substantially empty.

20 Claims, 2 Drawing Sheets

DISPENSING PACKAGE FOR SMALL ARTICLES

BACKGROUND OF THE INVENTION

This invention relates in general to display packages and deals more particularly with an improved counter display container for dispensing small articles as, for example, confectionary items, notions and the like.

It is common practice in retail trade to display small, low priced items at a check-out counter to encourage impulse buying. However, a sufficient supply of items must be maintained on the counter in an attractive controlled environment to satisfy the demands of casual purchasers without requiring frequent replenishment. If the displayed item is food stuff, such as a confectionary item, it is desirable that a small quantity of the item be displayed in an attractive dispenser which conveys the impression a purchased item has not been subjected to handling by others before purchase.

It is the general aim of the present invention to provide an improved container/dispenser which satisfies the aforesaid general requirements.

SUMMARY OF THE INVENTION

In accordance with the present invention an improved dispensing package for small articles comprises a container, means defining a drawer opening in a lower frontal portion of the container and a drawer supported within the lower portion of the container for movement from a closed position, wherein the drawer is substantially disposed within the container, to an open position wherein it extends from the the drawer opening and to a position beyond the front of the container. A means is provided for defining a hopper in the container when the drawer is in its open position for directing small articles from the upper portion of the container into the drawer and includes a chute wall which is disposed generally adjacent to an associated wall of the container when the drawer is in its closed position, a means is also provided for moving the chute wall to a position wherein the upper edge of the chute wall is engaged with a rear part of the container and the chute wall is inclined forwardly and downwardly toward the drawer opening in response to opening movement of the drawer. When the drawer is in its open position the chute wall cooperates with associated portions of the container walls to define the hopper.

DETAILED DESCRIPTION OF PREFERRED EMBODIMENT

Figure 1:
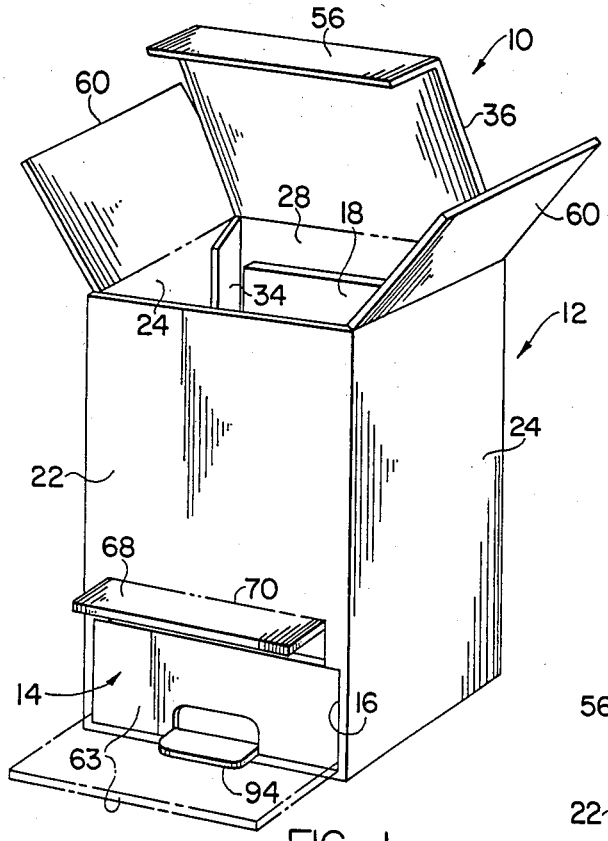
FIG. 1 is a perspective view of a dispensing container embodying the present invention.
Figure 2:
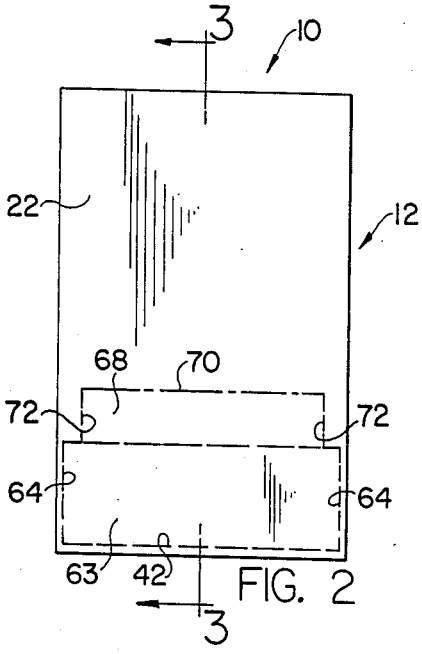
FIG. 2 is a front elevational view of the dispensing container.
Figure 3:
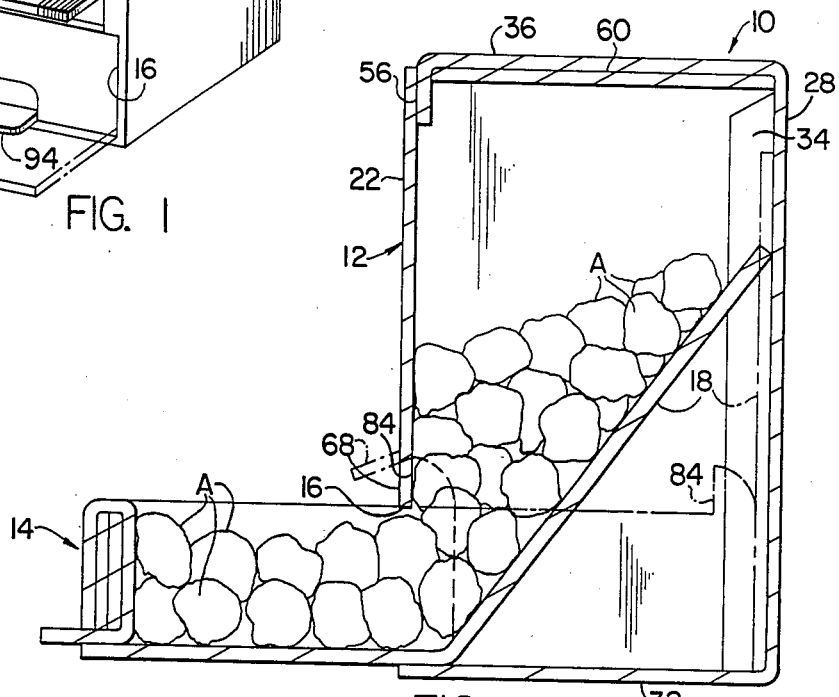
FIG. 3 is a somewhat enlarged vertical sectional view taken along the line 3—3 of FIG. 2.

Turning now to the drawings, a display package assembly for dispensing small articles and embodying the present invention is indicated generally by the reference numeral 10 in FIGS. 1–3. The illustrated package assembly 10 essentially comprises a rectangular container or carton for holding a quantity of small articles, designated generally by the reference numeral 12, and a drawer, indicated generally at 14, supported within the container 12 for movement from a closed position wherein it is substantially wholly disposed within the container to an open or dispensing position wherein it is partially disposed within the container and extends for some distance from a drawer opening 16 in the front of the container. The drawer 14 includes an associated movable chute wall 18 which is disposed in a generally upright position at the rear of the container 12 and extends a substantial distance above the drawer 14 when the drawer is in its closed position, as it appears in its broken line position of FIG. 3. The chute wall assumes a generally forwardly and downwardly inclined position when the drawer 14 is open, as it appears in full lines in FIG. 3, and cooperates with associated walls of the container 12 to form a hopper for directing loosely packed articles A,A disposed within the upper part of the container downwardly toward and into the drawer 14, all of which will be hereinafter more fully discussed.

Figure 4:
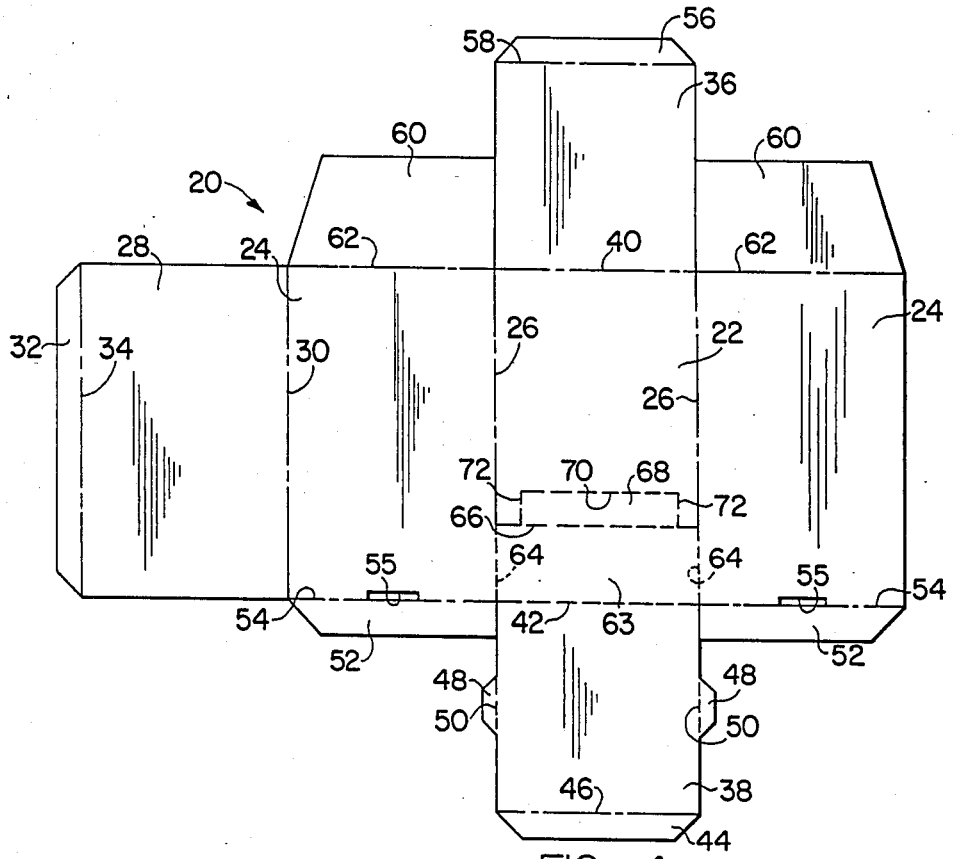
FIG. 4 is a somewhat reduced plan view of a container blank.

The container 12 may take various forms, but preferably it comprises a folded carton formed from a unitary blank die cut from sheet material, such as paperboard or the like, and in FIG. 4 there is shown a typical foldable container blank, indicated generally at 20, used to make the container 12. The illustrated blank 20 comprises a plurality of panels hingedly connected together along associated score or fold lines and which form the walls of a container and a plurality of connecting flaps and locating tabs connected to various panels along other score or fold lines and which maintain the container in set-up condition. More specifically, the blank 20 comprises a rectangular front panel 22 and a pair of side panels 24,24 connected to opposite side edges of the front panel 22 along score or fold lines 26,26. A rear panel 28 is connected along a score line 30 to the other side edge of one of the side panels. The other of the side panels has a connecting flap 32 attached to it along another score line 34. Rectangular top and bottom closure panels 36 and 38 are respectively connected to the upper and lower edges of the front panel 22. The top closure panel 36 is connected to the front panel along an associated fold line 40. However, the bottom closure panel 38 is connected to the front panel 22 along a line of weakening or perforation 42, for a reason which will be hereinafter evident. A connecting flap 44 is attached to the bottom panel 38 along an associated fold line 46. A pair of locating tabs 48,48 are also connected to opposite side edges of the bottom closure panel 38 along associated score lines 50,50. Connecting flaps 52,52 are attached to the lower edges of the side panels 24,24 along fold lines 54,54. A slot 55 is formed in the blank centrally of and coincident with each of the fold lines 54,54 for receiving the locating tabs 48,48 therein.

A closure flap 56 is connected to the top closure panel 36 along another score or fold line 58 and additional top closure flaps 60,60 are attached to the upper edges of the side panels 24,24 along associated fold lines 62,62.

The drawer opening 16 is formed by a tear-out panel 63 partially defined by the line of weakening or perforation 42 and further defined by additional lines of weakening 64,64 which extend upwardly from the line of weakening 42 coincident with the fold lines 26,26, and another line of weakening 66 which extends across the front panel 22 between the upper ends of the lines of weakening 64,64, substantially as shown. The tear out panel 63 has a width substantially equal to the width of the front panel 22.

A rectangular upper panel 68 of somewhat lesser width than the drawer opening is defined by the front panel 22 and disposed immediately above and centered on the drawer opening 16. The upper panel 68 is partially defined by the line of weakening 66 and further defined by a score line 70 and lines of weakening 72,72 which extend between the line of weakening 66 and opposite ends of the score line 70, substantially as shown in FIG. 4.

In its set up condition the blank 20 forms the generally rectangular container or carton 12. The blank is folded along parallel score lines 34,30, 26 and 26 to form a tubular structure of generally rectangular cross section and bring the connecting tab 32 into engagement with an associated inner surface portion of the side panel 24 at the opposite end of the blank 20 to which it is adhesively attached. The connecting flaps 52,52 are next folded inwardly along associated fold lines 54,54. The bottom closure panel 38 is then folded to closed position, the locating tabs 48,48 being inserted into associated slots 55,55. The carton 12 is completed by adhering the connecting flaps 52,52 to the inner surface of the bottom closure panel 38 and the connecting flap 44 to the inner surface of the rear panel 28 using a suitable adhesive compound.

The drawer may also be constructed in various ways and may, for example, be molded from plastic material. However, the presently preferred drawer 14 is formed from a unitary blank of sheet material, such as paperboard, and includes a plurality of connected panels which define the various walls of the drawer 14 and tabs which cooperate with the panels to maintain the drawer in set up condition.

Figure 5:
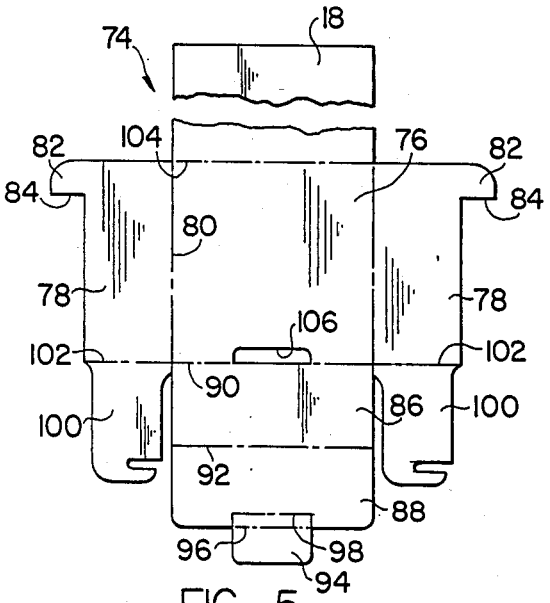
FIG. 5 is a somewhat reduced plan view of a drawer blank.

A typical paperboard blank used to make the drawer 14 is indicated generally by the numeral 74 in FIG. 5. The illustrated blank 74 includes a rectangular bottom panel 76 which defines the bottom wall of the drawer and a pair of sided panels 78,78 connected to the bottom panel 76 along score lines 80,80 and which define the drawer side walls. Each side panel 78 has an outwardly projecting drawer stop tab 82 which includes a forwardly facing abutment surface 84. The drawer front wall is defined by panels 86 and 88 connected together along a score line 92 and attached to the drawer bottom panel 76 along another score line 90 and 92.

A pull tab 94 is attached to a central portion of the panel 88 along score lines 96 and 98, substantially as shown. A pair of interlocking tab 100,100 are respectively attached to the forward edges of the side panels 78,78 along associated fold or score lines 102,102.

The chute wall 18 is connected to the rear edge of the drawer bottom panel or wall 76 along a fold line 104. A slot 106 is formed in the blank 74 coincident with the fold line 90 to receive the pull tab 94 therethrough.

The drawer 14 is formed from the blank 74 by folding the side panels or drawer side walls 78,78 upwardly relative to the bottom panel or wall 76. The interlocking tabs 100,100 are then folded inwardly toward each other and brought into interlocking engagement with each other. Thereafter the panel 86, which defines the front wall surface of the drawer, is folded upwardly along the fold line 90 and into face-to-face relation with the interlocked tabs 100,100. The panel 88 is next folded rearwardly and downwardly into the drawer along the fold line 92 and the pull tab 94 inserted into and through the slot 106 and folded upwardly along the score line 96 and to a position adjacent the drawer front wall surface 86, as it appears in broken lines in FIG. 1. The chute wall 18 is folded to an upwardly extending position relative to the bottom wall 76. The drawer 14 may now be inserted into the carton 12 through the open upper end of the carton, after which the carton may be filled and the top closure flap 38 closed and sealed, if desired.

The drawer 14 has a width substantially equal to the interior width dimension of the carton 12 and a length substantially equal to the interior length dimension of the carton as measured between the front panel 22 and the rear panel 28. When the drawer 14 is disposed within the carton the chute wall 18 is disposed generally adjacent inner surface of the rear panel 28 so that the upwardly open drawer substantially defines the lower end portion of the carton 12. Thus, the loss of carton volume due to the presence of the drawer 14 is relatively insignificant and substantially the entire volume of the carton 12 is available to be filled with small articles.

The display package 10 is set up for counter display by tearing the removable panel 63 away from the front panel 22 along the lines of weakening 42,66 and 64,64 and separating the upper panel 68 along the lines of weakening 72,72 and folding it upwardly along the fold line 70. The drawer may now be pulled to an open or display position. The upper panel 68 provides clearance above the front wall of the drawer to enable the drawer to be opened even when articles contained within the drawer extend for some distance above the upper edge of the drawer front wall. The abutment surfaces 84,84 on the drawer stop tabs 84,84 engage associated inner surfaces of the front panel 22 to limit outward movement of the drawer 14.

The relatively light weight loosely packed material normally contained within the carton offers little resistance to movement of the chute wall 18 away from the rear panel as the drawer is opened. Since the drawer is preferably made from paperboard or other relatively flexible material, the chute wall 18 is free to bend, as necessary to allow the drawer to be moved to its open position. The chute wall 18 ultimately assumes a position wherein its upper edge rests against the rear panel 28 and it is inclined generally forwardly and downwardly from the rear panel 28 toward the bottom of the drawer 12. In the latter position the chute wall 18 cooperates with the carton front panel 22 and side panels 24,24 to form a hopper for directing small articles from the upper part of the carton and into the drawer 14. When the drawer is fully opened the top flap 68 may, if desire, be folded downward to its original position wherein it lies within the plane of the carton front panel 22. Thereafter, as articles are removed from the open drawer other articles within the carton are fed by the hopper into the drawer so that the drawer will remain substantially full until the contents of the carton have been emptied by the hopper into the drawer.

We claim:

1. A dispensing package comprising a container, means for defining a drawer opening in a lower frontal portion of said container, a drawer supported within said lower portion for movement from a closed position wherein said drawer is disposed within said container to an open position wherein said drawer projects from said container, and means defining a hopper within said container when said drawer is in its open position for directing articles disposed within the upper portion of said container into said drawer and including a chute wall disposed within said container and extending above said drawer, said chute wall being disposed generally adjacent an associated wall of said container when said drawer is in its closed position, and means for moving said chute wall to another position wherein it is forwardly and downwardly inclined toward said drawer in response to movement of said drawer to its open position, said chute wall cooperating with associated portions of the walls of said container to define said hopper.

2. A dispensing package as set forth in claim 1 wherein said means for defining a drawer opening comprises a tear-open panel formed by a frontal portion of said container for exposing said drawer opening.

3. A dispensing package as set forth in claim 2 wherein said frontal portion comprises a front panel of said container and said tear-open panel comprises a portion of said front panel defined by lines of weakening formed on said front panel.

4. A dispensing package as set forth in claim 3 wherein said tear-open panel is separable from said front panel along said lines of weakening.

5. A dispensing package as set forth in claim 3 wherein said drawer opening is defined by the bottom of said container and associated portions of the side walls of said container.

6. A dispensing package as set forth in claim 3 including an upper panel disposed above said tear-open panel and defined in part by an associated one of said lines of weakening.

7. A dispensing package as set forth in claim 6 wherein the lower edge of said upper panel and a portion of the upper edge of said tear-open panel are defined by a common line of weakening.

8. A dispensing package as set forth in claim 7 wherein the width of said drawer opening is greater than the width of said upper panel.

9. A dispensing package as set forth in claim 1 wherein said means for defining said drawer opening also comprises means for defining an upper panel in said lower frontal position above said drawer opening.

10. A dispensing package as set forth in claim 9 wherein said upper panel is hingedly connected to said frontal portion above said drawer opening.

11. A dispensing package as set forth in claim 10 wherein the lower portion of said upper panel defines an upper portion of said drawer opening.

12. A dispensing package as set forth in claim 1 wherein said means for moving said chute wall comprises means for connecting said chute wall to said drawer.

13. A dispensing package as set forth in claim 12 wherein said drawer and said chute wall are formed from a single sheet of material and said means for connecting said chute wall to said drawer comprises a fold line formed on said material.

14. A dispensing package as set forth in claim 12 wherein said drawer includes a bottom wall and said chute wall is hingedly attached to the rear edge of said bottom wall.

15. A dispensing package as set forth in claim 1 wherein said chute wall is formed from flexible material.

16. A dispensing package assembly for containing and dispensing small articles and comprising a generally rectangular container formed by a plurality of connected panels including a front panel, a pair of opposing side panels, a rear panel, a bottom closure panel and a top closure panel, means defining a drawer opening through a lower portion of said front panel and including a plurality of lines weakening on said front panel, a drawer wholly disposed within said container in a closed position, said drawer in its closed position defining a lower portion of said container, said drawer being movable from said closed position through said drawer opening and to an open position, a movable chute wall disposed within said container, said chute wall being disposed generally adjacent said rear panel when said drawer is in its closed position, and means for moving said chute wall to a position wherein it is forwardly and downwardly inclined from said rear panel toward said drawer in response to opening movement of said drawer, said chute wall cooperating with associated portion of said front and side panels of said container to form a hopper for directing into said drawer small articles contained within the upper portion of said container when said drawer is in its open position.

17. A dispensing package as set forth in claim 16 wherein said means for moving said chute wall comprises means connecting said chute wall to said drawer.

18. A dispensing package as set forth in claim 17 wherein said drawer and chute wall comprise a unitary structure and said chute wall is connected to said drawer along a fold line formed on said structure.

19. A dispensing package as set forth in claim 16 wherein said container includes means defining an upper panel hingedly connected to said front panel above said drawer opening and movable to a position relative to said front panel to expose another opening through said front panel communicating with the upper portion of said drawer opening.

20. A dispensing package as set forth in claim 19 wherein a portion of said drawer opening and a portion of said upper panel are defined by a common line of weakening.

* * * * *